US007820612B2

(12) United States Patent
English, III et al.

(10) Patent No.: US 7,820,612 B2
(45) Date of Patent: Oct. 26, 2010

(54) LAUNDRY DETERGENT CONTAINING METHYL ESTER SULFONATE

(75) Inventors: Jack Wesley English, III, West Chester, OH (US); Eva Schneiderman, Mason, OH (US); Shari Joy Soper, Mason, OH (US); Jared John Schaefer, Wyoming, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 128 days.

(21) Appl. No.: 11/818,162

(22) Filed: Jun. 13, 2007

(65) Prior Publication Data

US 2008/0004199 A1 Jan. 3, 2008

Related U.S. Application Data

(60) Provisional application No. 60/814,727, filed on Jun. 19, 2006.

(51) Int. Cl.
*C11D 17/00* (2006.01)

(52) U.S. Cl. ..... 510/424; 510/426; 510/428; 510/492

(58) Field of Classification Search ..... None
See application file for complete search history.

(56) References Cited

U.S. PATENT DOCUMENTS 5,616,781 A * 4/1997 Sajic et al. ..... 510/221
5,637,758 A 6/1997 Sajic et al.
6,407,050 B1 6/2002 Huish et al.

FOREIGN PATENT DOCUMENTS

WO WO 02/28993 A1 4/2002

OTHER PUBLICATIONS

International Search Report, mailed Dec. 21, 2007, 4 pages.

* cited by examiner

*Primary Examiner*—Necholus Ogden, Jr.
(74) *Attorney, Agent, or Firm*—Marianne Dressman; Armina E. Matthews; Leonard W. Lewis

(57) ABSTRACT

Laundry detergent compositions containing from about 6% to about 35% of a surfactant component; wherein the surfactant component comprises: from about 0.5 to about 15%, by weight of the composition, of an MES blend having an average level of disalt of from about 8% to about 50%, wherein said MES blend comprises C16 MES; and wherein a ratio of C16 MES to surfactant component is less than about 0.3.

15 Claims, No Drawings

LAUNDRY DETERGENT CONTAINING METHYL ESTER SULFONATE

CROSS REFERENCE TO RELATED APPLICATION

This application claims the benefit of U.S. Provisional Application Ser. No. 60/814,727, filed Jun. 19, 2006.

FIELD OF THE INVENTION

The present invention relates to laundry detergent compositions containing methyl ester sulfonates with improved cleaning, good stability and lower cost.

BACKGROUND OF THE INVENTION

Methyl Ester Sulfonate ("MES") surfactants are currently used in many applications including laundry detergents and may be produced from renewable resources such as palm oil or coconut oil. In recent years as the price of petrochemicals has increased, these renewable resource surfactants have become a more attractive option for inclusion in certain laundry detergent formulas. The process for the production of MES is well known and established (See, for example, U.S. Pat. Nos. 5,587,500; 5,723,533; and 6,058,623 to The Chemithon Corporation). Generally speaking, natural oils (or triglycerides) are chemically converted to methyl esters and glycerol. The methyl esters are then sulfonated on the alpha-position, which is followed by a digestion step to ensure optimal conversion to the desired alpha-sulfonated methyl ester sulfonate molecule. After the digestion step, the material is typically bleached and neutralized, and these two steps can be done in either order according to certain processes known in the art.

Various by-products may be formed during the MES process, and each can have an impact on the overall performance and stability of the MES in the finished detergent formula. One such by-product is commonly referred to as "di-salt", and can be described as the neutralized form of the desired MES molecule (sulfonated and neutralized on the alpha position) that has also had the methyl portion of the ester neutralized with another cation. This di-salt molecule has different properties than the equivalent MES molecule, and can give rise to certain performance and stability issues. For this reason, most MES processes attempt to minimize the level of di-salt that is formed during the process (typically the standard is less than about 10%). This is typically accomplished by tightly controlling the neutralization step to avoid areas of high pH, and also by minimizing the level of water that is present prior to neutralization.

This minimization of di-salt level requires processing investments, and thus the price of MES material with low di-salt level is generally higher than an MES with higher di-salt level. In the past, because di-salt has been perceived as an undesirable material that can negatively impact cleaning performance and stability, this extra cost has been accepted.

Therefore, a need exists to develop reduced cost laundry detergent compositions that have both good cleaning performance and stability that can utilize the less-expensive MES having a higher level of di-salt.

SUMMARY OF THE INVENTION

It has now been surprisingly found that MES with a higher level of di-salt may be successfully formulated with good cleaning performance and stability. Additionally, it has now been surprisingly found that the color of MES achieved with a given process can be improved if the di-salt level is allowed to increase. Without being limited by theory, this is due to the fact that a more rigorous bleaching step can be carried out with less concern over forming a certain level of di-salt.

Therefore, the present invention relates to a laundry detergent composition comprising:

a) from about 6% to about 35% of a surfactant component comprising:

i) from about 0.5 to about 15%, by weight of the composition, of an MES blend having an average level of disalt of from about 8% to about 50%, wherein said MES blend comprises C16 MES, preferably wherein the ratio of C16 MES to total surfactant is less than about 0.3, more preferably is less than about 0.2; and ii) wherein a ratio of C16 MES to surfactant component is less than about 0.3.

The present invention further relates to a liquid or gel laundry detergent composition comprising:

a) from about 6% to about 35% of a surfactant component; and b) water;

wherein the surfactant component comprises:

iii) from about 0.5 to about 15%, by weight of the composition, of an MES blend having an average level of disalt of from about 8% to about 50%, wherein said MES blend comprises C16 MES, preferably wherein the ratio of C16 MES to total surfactant is less than about 0.3, more preferably is less than about 0.2; and iv) wherein a ratio of C16 MES to surfactant component is less than about 0.3.

The present invention further relates to the compositions above wherein, the surfactant component comprises from about 0.5 to about 6% of C16 MES having an average level of disalt greater than about 20%.

The present invention further relates to the compositions above wherein, the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.7.

The present invention further relates to the compositions above wherein, the MES blend has an average level of disalt from about 15% to about 25%, by weight of the MES blend.

The present invention further relates to the compositions above wherein, the MES blend has an average level of disalt of from about 8% to about 50%, alternatively from about 10 to about 50%, alternatively from about 10% to about 40%, alternatively from about 12% to about 40%, still alternatively from about 15% to about 25%, by weight of the MES blend.

The present invention further relates to the compositions above wherein, the surfactant component comprises at least one other major surfactant selected from the group of highly soluble alkyl sulfates, linear alkyl benzene sulfonate, ethoxylated alkyl sulfates, ethoxylated alcohols, and mixtures thereof.

The present invention further relates to the compositions above wherein, the surfactant component comprises MES and AES, wherein the ratio of MES to AES is lower than 0.6.

The present invention further relates to the compositions above wherein, the surfactant component comprises MES and AES, wherein the ratio of MES to AES is lower than 0.5.

The present invention further relates to the compositions above wherein, the surfactant component further comprises LAS and HSAS and wherein the sum of LAS and HSAS is less than or equal to the sum of AES, MES and nonionic surfactants.

The present invention further relates to the compositions above wherein, the surfactant component contains HSAS and the ratio of HSAS to MES is from about 1:6 to about 6:1.

The present invention further relates to the compositions above wherein, the composition further comprises one or more optional detergent ingredients.

The present invention further relates to the compositions above wherein, the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.6, preferably less than about 0.5

DETAILED DESCRIPTION OF THE INVENTION

Laundry Detergent Composition

The laundry detergent compositions of the present invention contain MES surfactant and may be in a number of forms, including granular, powder, liquid, gel, tablet, liquid-tab, or combinations thereof. In one embodiment, the laundry detergent composition is a heavy duty liquid laundry detergent composition. In another embodiment, the laundry detergent composition is a granular detergent. Examples of granular and/or powder detergent compositions may be found in; e.g., U.S. Pat. Nos. 4,412,934; 4,490,271; 4,515,705; 4,587,054; 4,605,509; 4,986,420; 4,997,590; 5,137,209; 5,373,960; 5,458,809; 5,458,810; 5,460,752; 5,470,507; 5,489,392; 5,516,448; 5,554,587; 5,565,422; 5,569,645; 5,679,630; 5,691,297; 5,733,862; 5,795,854; 5,891,838; 5,932,532; 5,955,419; 6,015,781; 6,017,871; 6,020,303; 6,060,443; 6,066,611; 6,133,222; 6,228,828; 6,228,829; 6,251,846; 6,326,348; 6,384,011; 6,689,739.

Therefore, the present invention relates to a laundry detergent composition comprising:

a) from about 6% to about 35% of a surfactant component comprising:

v) from about 0.5 to about 15%, by weight of the composition, of an MES blend having an average level of disalt of from about 8% to about 50%, wherein said MES blend comprises C16 MES, preferably wherein the ratio of C16 MES to total surfactant is less than about 0.3, more preferably is less than about 0.2; and vi) wherein a ratio of C16 MES to surfactant component is less than about 0.3.

The present invention further relates to a liquid or gel laundry detergent composition comprising:

a) from about 6% to about 35% of a surfactant component; and b) water;

wherein the surfactant component comprises:

vii) from about 0.5 to about 15%, by weight of the composition, of an MES blend having an average level of disalt of from about 8% to about 50%, wherein said MES blend comprises C16 MES, preferably wherein the ratio of C16 MES to total surfactant is less than about 0.3, more preferably is less than about 0.2; and viii) wherein a ratio of C16 MES to surfactant component is less than about 0.3.

The present invention further relates to the compositions above wherein, the surfactant component comprises from about 0.5 to about 6% of C16 MES having an average level of disalt greater than about 20%.

The present invention further relates to the compositions above wherein, the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.7.

The present invention further relates to the compositions above wherein, the MES blend has an average level of from about 8% to about 50%, by weight of the MES blend.

The present invention further relates to the compositions above wherein, the MES blend has an average level of disalt of from about 8% to about 50%, by weight of the MES blend.

The present invention further relates to the compositions above wherein, the MES blend has an average level of from about 15% to about 25%, by weight of the MES blend.

The present invention further relates to the compositions above wherein, the MES blend has an average level of disalt of from about 8% to about 50%, alternatively from about 10 to about 50%, alternatively from about 10% to about 40%, alternatively from about 12% to about 40%, still alternatively from about 15% to about 25%, by weight of the MES blend.

The present invention further relates to the compositions above wherein, the surfactant component comprises at least one other major surfactant selected from the group of highly soluble alkyl sulfates, linear alkyl benzene sulfonate, ethoxylated alkyl sulfates, ethoxylated alcohols, and mixtures thereof.

The present invention further relates to the compositions above wherein, the surfactant component comprises MES and AES, wherein the ratio of MES to AES is lower than 0.6.

The present invention further relates to the compositions above wherein, the surfactant component comprises MES and AES, wherein the ratio of MES to AES is lower than 0.5.

The present invention further relates to the compositions above wherein, the surfactant component further comprises LAS and HSAS and wherein the sum of LAS and HSAS is less than or equal to the sum of AES, MES and nonionic surfactants.

The present invention further relates to the compositions above wherein, the surfactant component contains HSAS and the ratio of HSAS to MES is from about 1:6 to about 6:1.

The present invention further relates to the compositions above wherein, the composition further comprises one or more optional detergent ingredients.

The present invention further relates to the compositions above wherein, the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.6, preferably less than about 0.5

Surfactant Component

The laundry detergent compositions of the present invention contain from about about 6% to about 90%, by weight of the composition, of a surfactant component. In one embodiment, the composition contains from about 6% to about 50%, alternatively from about 6% to about 35%, by weight of the composition, of a surfactant component.

The surfactant component includes an MES blend and may optionally include other surfactants. In addition to the MES surfactant, other surfactants that may be used herein include anionic, nonionic, cationic, zwitterionic and/or amphoteric surfactants.

Alkyl Ester Sulfonate Surfactant ("MES")

As used herein, "MES" refers to alkyl ester sulfonates surfactants, commonly used in methyl ester sulfonate form. The present invention relates to laundry detergent compositions comprising MES. MES surfactants useful herein include sulfonated fatty acid alkyl esters of the formula:

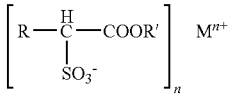

wherein R is, on the average, a C6 to C22 alkyl, R' is on the average a C1 to C8 alkyl, M is an alkali metal or alkaline earth metal cation, or a mixture thereof, and n is 1 when M is an alkali metal cation and n is 2 when M is an alkaline earth metal cation.

The hydrophobic portion of these sulfonated alkyl esters have the sulfonate group at the α-position, i.e., the sulfonate group is positioned at the carbon atom adjacent the carbonyl group. The alkyl portion of the hydrophobic portion, which corresponds to the R portion of the sulfonated fatty acid alkyl esters, is on the average a C6 to C22 alkyl. Preferably, the alkyl portion of this hydrophobic portion, R, is on the average a straight-chain C8 to C16 hydrocarbon particularly when R' is methyl.

R', forming the ester portion of the sulfonated alkyl esters, is on the average a C1 to C8 alkyl. Preferably, R' is on the average a C1 to C6 alkyl, and most preferably a C1 alkyl, i.e., methyl.

In one embodiment, the distribution is such that R is, on the average, a C14 to C16 alkyl (approximately, for example, a 95% C14, 5% C16 mixture) and R' is methyl. In another embodiment, the distribution is such that R is, on the average, a C12 to C16 alkyl (approximately, for example, a 3% C12, 28% C14, 69% C16 mixture) and R' is methyl. In yet another embodiment, the distribution is such that R is, on the average, a C10 to C16 alkyl (approximately, for example, a 60% C10, 35% C12, 5% C14 mixture) and R' is methyl. In yet a further embodiment, blends of the aforementioned distributions of R and R' may also be employed.

The cationic portion, M, is an alkali metal or alkaline earth metal cation or mixture thereof. Preferably, M is chosen from sodium, potassium, lithium, magnesium, calcium, and mixtures thereof. Most preferably, M is sodium or a mixture containing sodium. When M is an alkali metal cation (valence=1) n is 1 and when M is an alkaline earth metal cation (valence=2) n is 2.

Methods of making alkyl ester surfactants have been well described and are known to those skilled in art the art. See U.S. Pat. Nos.: 4,671,900; 4,816,188; 5,329,030; 5,382,677; 5,384,422; 5,475,134; 5,587,500; 6,780,830. MES is commercially available from Huish.

MES used in the processes and compositions of the present invention may be included in any form, as solid/flake and/or liquid surfactant premix.

Depending on the embodiment, a surfactant useful in the present invention may be a "major surfactant". As used herein, "major surfactant" refers to any detergent surfactant that is present in the composition in amounts of from about 1% or greater, by weight of the composition.

Anionic Surfactants

Suitable anionic surfactants useful herein include any of the conventional anionic surfactant types typically used in detergent products. These include the alkyl benzene sulfonic acids and their salts as well as alkoxylated or non-alkoxylated alkyl sulfate materials.

Exemplary anionic surfactants are the alkali metal salts of $C_{10-16}$ alkyl benzene sulfonic acids, preferably $C_{11-14}$ alkyl benzene sulfonic acids. In one embodiment, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Preferred are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: $R'—O—(C_2H_4O)_n—SO_3M$ wherein R' is a $C_8$-$C_{20}$ alkyl group, n is from about 1 to 20, and M is a salt-forming cation. In a specific embodiment, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3^-M^+$ wherein R is typically a linear $C_8$-$C_{20}$ hydrocarbyl group, which may be straight chain or branched chain, and M is a water-solubilizing cation. In specific embodiments, R is a $C_{10}$-$C_{15}$ alkyl, and M is alkali metal, more specifically R is $C_{12}$-$C_{14}$ and M is sodium.

Examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3) alkyl sulfates having formulae (I) and (II):

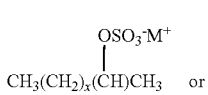

(I)

or

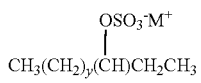

(II)

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$-$C_{18}$ alkyl alkoxy sulfates ($AE_xS$) wherein preferably x is from 1-30; e) $C_{10}$-$C_{18}$ alkyl alkoxy carboxylates preferably comprising 1-5 ethoxy units; f) mid-chain branched alkyl sulfates as discussed in U.S. Pat. No. 6,020,303 and U.S. Pat. No. 6,060,443; g) mid-chain branched alkyl alkoxy sulfates as discussed in U.S. Pat. No. 6,008,181 and U.S. Pat. No. 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Nonionic Surfactants

Suitable nonionic surfactants useful herein can comprise any of the conventional nonionic surfactant types typically used in detergent products. These include alkoxylated fatty alcohols and amine oxide surfactants. Typical for use in the detergent compositions herein are those nonionic surfactants which are normally liquid.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$-$C_{16}$ alkyl group, m is from 2 to 4, and n ranges from about 2 to 12. Preferably $R^1$ is an alkyl group, which may be primary or secondary, which contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

The alkoxylated fatty alcohol materials useful in the laundry detergent compositions herein will frequently have a hydrophilic-lipophilic balance (HLB) which ranges from about 3 to 17. The HLB of this material may range from about 6 to 15, alternatively from about 8 to 15. Alkoxylated fatty alcohol nonionic surfactants have been marketed under the tradenames NEODOL and DOBANOL by the Shell Chemical Company.

Another suitable type of nonionic surfactant useful herein is the amine oxide surfactants. Amine oxides are materials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Other nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as Pluronic® from BASF; d) $C_{14}$-$C_{22}$ mid-chain branched alcohols, BA, as discussed in U.S. Pat. No. 6,150,322; e) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856; f) Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

Anionic/Nonionic Combinations

In the laundry detergent compositions herein, the surfactant component may include combinations of anionic and nonionic surfactants with MES. When this is the case, the weight ratio of anionic to nonionic will typically range from 10:90 to 90:10, more typically from 30:70 to 70:30.

Cationic Surfactants

Cationic surfactants are well known in the art and examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine (APA).

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$ to $C_{18}$ (preferably $C_{12}$ to $C_{18}$) amine oxides and sulfo and hydroxy betaines, such as N-alkyl-N,N-dimethylammino-1-propane sulfonate where the alkyl group can be $C_8$ to $C_{18}$, preferably $C_{10}$ to $C_{14}$.

Ampholytic Surfactants

Examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 to Laughlin et al., issued Dec. 30, 1975 at column 19, lines 18-35, for examples of ampholytic surfactants.

Other Optional Detergent Ingredients

The laundry detergent compositions herein may contain one or more optional detergent ingredients.

Optional detergent ingredients useful herein include those known in the art for use in laundry detergents such as hueing dyes, opacifiers, viscosity modifiers, detersive builders, enzymes, enzyme stabilizers (such as propylene glycol, boric acid and/or borax), suds suppressors, soil suspending agents, soil release agents, other fabric care benefit agents, polymers, softeners, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 0.1% to about 50%, more preferably from about 1% to about 30%, by weight of the composition.

In one embodiment of the instant invention, the adjunct ingredient may be selected from builders, brightener, dye transfer inhibitor, chelants, polyacrylate polymers, dispersing agents, colorant dye, hueing dyes, perfumes, processing aids, bleaching additives, bleach activators, bleach precursors, bleach catalysts, solvents, co-solvents, hydrotropes, liquid carrier, phase stabilizers, soil release polymers, enzyme stabilizers (other than the reversible peptide protease inhibitor, and/or the reversible aromatic protease inhibitor described herein), suds suppressors, opacifiers, suds boosters, anticorrosion agents, radical scavengers, chlorine scavengers, structurants, fabric softening additives, other fabric care benefit agents, pH adjusting agents, fluorescent whitening agents, smectite clays, structuring agents, preservatives, thickeners, coloring agents, fabric softening additives, rheology modifiers, fillers, germicides and mixtures thereof. (See, U.S. Pat. No. 3,936,537, issued Feb. 3, 1976 to Baskerville, Jr. et al., See also, U.S. Pat. No. 4,285,841, Barrat et al., issued Aug. 25, 1981, See also, U.S. Pat. No. 4,844,824 Mermelstein et al., issued Jul. 4, 1989, See also, U.S. Pat. No. 4,663,071, Bush et al., See also, U.S. Pat. No. 4,909,953, Sadlowski, et al. issued Mar. 20, 1990, See also, U.S. Pat. No. 3,933,672, issued Jan. 20, 1976 to Bartoletta et al. and U.S. Pat. No. 4,136,045, issued Jan. 23, 1979 to Gault et al. and See also, U.S. Pat. No. 4,762,645, Tucker et al, issued Aug. 9, 1988, Column 6, line 3 through Column 7, line 24.)

The list of optional detergent ingredients above is not intended to be exhaustive and other optional detergent ingredients which may not be listed, but are well known in the art, may also be included in the composition.

Aesthetics

The detergent compositions set forth herein, as well as any commercial or non-commercial container therefore, may have any desired appearance or aesthetics. The composition and/or container may be opaque, transparent or translucent, of any color or appearance, such as a pearlescent liquid. In one embodiment, the concentrated detergent composition may contain air or gas bubbles, suspended liquid droplets, simple or multiple emulsion droplets, suspended particles and the like and combinations thereof. Additionally, the composition and/or container may be any color or combination of colors. Furthermore, the composition and/or container may have any additional visual treatments, such as for example, a combination of varied refractive indices, pearlescence, opalescence, reflective, holographic effect, metallic color, gloss finish, matte finish and the like and combinations thereof.

In one embodiment, the laundry detergent composition of the present invention is translucent or transparent and is packaged in a container that is translucent or transparent, alternatively, such composition further contains a UV absorber or optical brightener in combination with a hueing dye and MES surfactant.

Methods of Use

The compositions of herein, can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith.

EXAMPLES

Examples 1A and 1B

Liquid laundry detergent compositions containing MES with 20% di-salt.

EXAMPLES 1A AND 1B

| Ingredient | 1A wt % in composition | 1B wt % in composition |
|---|---|---|
| C25 AE1.8S*H | 17 | 6.25 |
| MSAS surfactant | 3.4 | 1.5 |
| Sodium hydroxide | 4.0 | 1.25 |
| MEA | 2.5 | 4.6 |
| 1,2-Propanediol | 4.2 | 2.75 |
| Diethylene glycol | 3.25 | 5.0 |
| Nonionic surfactant | 0.8 | 8.0 |
| Brightener | 0.2 | 0.2 |
| DTPA | 0.250 | 0.25 |
| C11.8 HLAS | 5.0 | 2.5 |
| Citric Acid | 3.800 | 3.500 |
| calcium formate | 0.075 | 0.075 |
| C12-18 Fatty Acid | 2.0 | 5.0 |
| borax | 2.0 | 2.0 |
| Viscosity modifier | 0.6 | 1.0 |
| C16MES having 20% di-salt | 4.000 | 12.000 |
| water | to 100% | to 100% |
| perfume | 0.5 | 0.6 |
| dye | 0.010 | |
| enzyme | 0.4 | 0.6 |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising:

a) from about 6% to about 35% of a surfactant component; and b) water;

wherein the surfactant component comprises:

i) from about 0.5 to about 15%, by weight of the composition, of an MES blend having an average level of disalt of greater than about 20%, wherein said MES blend comprises C16 MES; and ii) wherein a ratio of C16 MES to surfactant component is less than about 0.3.

2. A laundry detergent composition according to claim 1 wherein the surfactant component comprises from about 0.5 to about 6% of C16 MES.

3. A laundry detergent composition according to claim 1 wherein the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.7.

4. A laundry detergent composition according to claim 1 wherein the MES blend has an average level of disalt of from about 15% to about 25%, by weight of the MES blend.

5. A laundry detergent composition according to claim 3 wherein the MES blend has an average level of disalt of from about 15% to about 25%, by weight of the MES blend.

6. A laundry composition according to claim 1 wherein the surfactant component comprises at least one other major surfactant selected from the group of highly soluble alkyl sulfates, linear alkyl benzene sulfonate, ethoxylated alkyl sulfates, ethoxylated alcohols, and mixtures thereof.

7. A laundry composition according to claim 1 wherein the surfactant component comprises MES and AES, wherein the ratio of MES to AES is lower than 0.6.

8. A laundry composition according to claim 1 wherein the surfactant component comprises MES and AES, wherein the ratio of MES to AES is lower than 0.5.

9. A laundry composition according to claim 3 wherein the surfactant component comprises MES and AES, wherein the ratio of MES to AES is lower than 0.5.

10. A laundry composition according to claim 8 wherein the surfactant component further comprises LAS and HSAS and wherein the sum of LAS and HSAS is less than or equal to the sum of AES, MES and nonionic surfactants.

11. A laundry composition according to claim 1 wherein the surfactant component contains HSAS and the ratio of HSAS to MES is from about 1:6 to about 6:1.

12. A laundry composition according to claim 1 wherein the composition further comprises one or more optional detergent ingredients.

13. A laundry detergent composition according to claim 1 wherein the surfactant component comprises from about 0.5% to about 6%, by weight of the composition, of the MES blend, wherein said MES blend further comprises at least one other chainlength of MES selected from C10, C12, C14, C18 and mixtures thereof, and wherein the ratio of MES blend to surfactant component is less than about 0.6.

14. A laundry detergent composition according to claim 13 wherein the ratio of MES blend to surfactant component is less than about 0.5.

15. A laundry detergent composition comprising:

a) from about 6% to about 35% of a surfactant component; and b) water;

wherein the surfactant component comprises:

i) from about 0.5 to about 15%, by weight of the composition, of an MES blend having an average level of disalt of from about 8% to about 50%, wherein said MES blend comprises C16 MES;

ii) LAS;

iii) HSAS; and iv) wherein a ratio of C16 MES to surfactant component is less than about 0.3.

* * * * *